United States Patent [19]

Haesebrouck

[11] Patent Number: 4,926,761

[45] Date of Patent: May 22, 1990

[54] ARMOR PARTICULARLY FOR A SAFE AND A SAFE THUS PRODUCED

[75] Inventor: Francis Haesebrouck, Paris la Défense, France

[73] Assignee: Usines et Acieries de Sambre et Meuse, Feignies, France

[21] Appl. No.: 244,515

[22] Filed: Sep. 9, 1988

[30] Foreign Application Priority Data

Sep. 9, 1987 [FR] France ..... 87 12512

[51] Int. Cl.[5] ..... E06B 9/00; E04B 2/02

[52] U.S. Cl. ..... 109/49.5; 109/84; 109/85

[58] Field of Search ..... 109/49.5, 76, 80–85

[56] References Cited

U.S. PATENT DOCUMENTS

| | | | |
|---|---|---|---|
| 1,605,443 | 11/1926 | Kennedy . | |
| 1,703,417 | 2/1929 | Donaldson . | |
| 1,888,042 | 11/1932 | Lynn et al. . | |
| 3,645,216 | 2/1972 | Radford et al. . | |
| 3,684,497 | 8/1972 | Wendler et al. | 109/82 |
| 3,874,855 | 4/1975 | Legrand | 109/84 |
| 3,898,729 | 8/1975 | Greene . | |
| 4,178,859 | 12/1979 | Seiz et al. | 109/85 |
| 4,696;240 | 9/1987 | Maxeiner | 109/82 |

FOREIGN PATENT DOCUMENTS

| | | |
|---|---|---|
| 0171377 | 2/1986 | European Pat. Off. . |
| 2538009 | 5/1983 | Fed. Rep. of Germany . |
| 196348 | 4/1923 | United Kingdom . |

*Primary Examiner*—Neill R. Wilson

*Attorney, Agent, or Firm*—Young & Thompson

[57] ABSTRACT

The armor comprises a plate of refractory steel (1) resistant to cracking by means of a known torch. One or more inserts (2) of refractory material resistant to an added metal torch are encased in the refractory steel (1), the structure and distribution in the interior of the steel of this insert or of these inserts (2) being such that the plate comprises a series of zones, distributed over the whole of the plate, which are separated by zones in which the thickness of the steel is different. Application particularly to safes.

32 Claims, 4 Drawing Sheets

Figure 1:
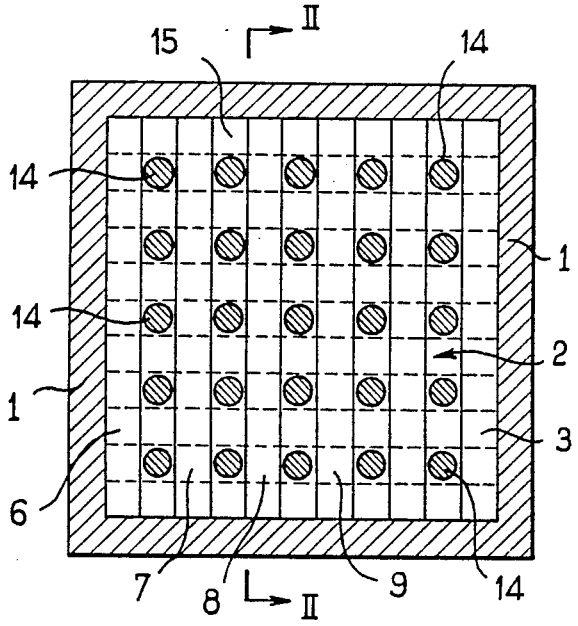

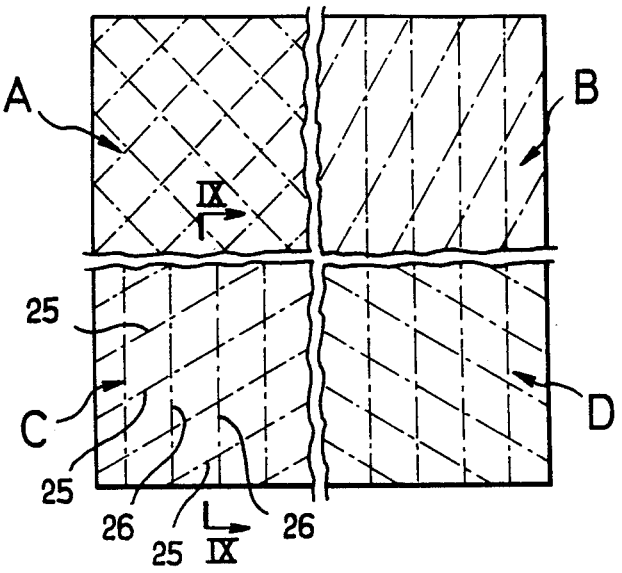
FIG. 8 A à D
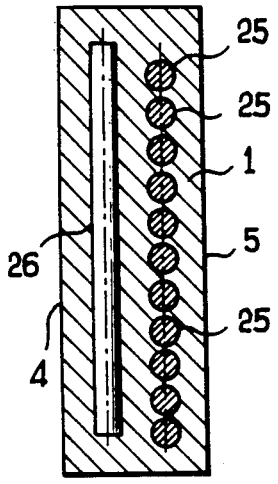
FIG. 9
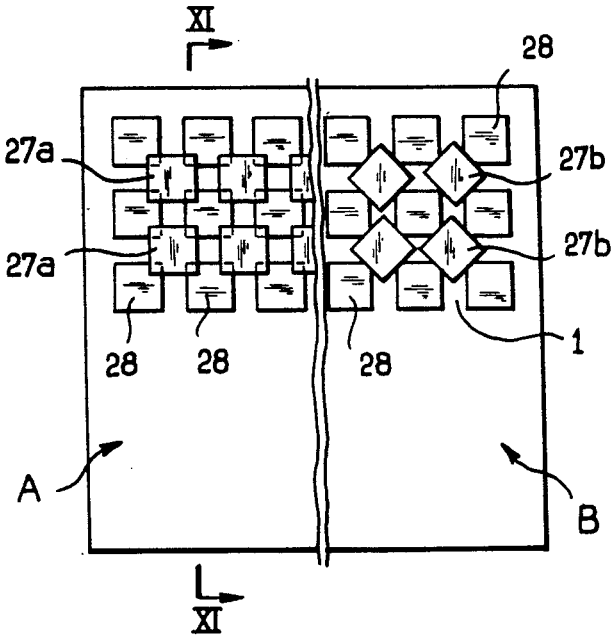
FIG. 10 A et B
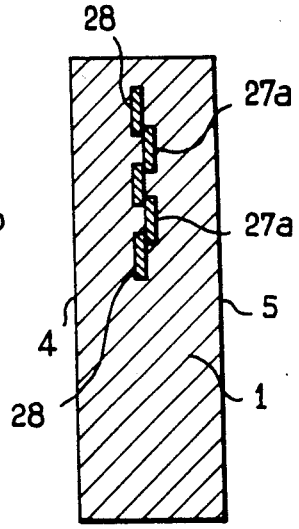
FIG. 11

ARMOR PARTICULARLY FOR A SAFE AND A SAFE THUS PRODUCED

The present invention relates to armor particularly for a safe comprising a base plate of refractory steel resisting cracking by means of a conventional oxyacetylene torch.

The invention also relates to a safe formed of several armor plates of the type mentioned.

The specifications provide in general, for safe armor to be adapted to be homologous, that is that it be impossible to produce in the armor an opening of certain dimensions in less than a minimum stated time, no matter what tools are used, namely an oxyacetylene torch with added metallic powder, a pick, a sledge hammer, a drill with special bits, etc.

The presently known safe armors which satisfy these specifications require considerable thicknesses (for example, a minimum thickness of 70 mm, in the best case, to satisfy the French specification No. CNCA RM/RT 30 p.b. of Sept., 1980, specifying an opening of 150 $cm^2$ and a minimum time of 30 minutes). As a result, these armors are heavy, bulky and costly.

The object of the present invention is to overcome the drawbacks of known constructions by providing an armor which has improved resistance relative to cracking attempts such that it may be used in current applications with a thickness less than that of known constructions.

According to the invention, the armor, particularly for a safe, comprising a plate of refractory steel resisting cracking with a conventional torch, is characterized in that one or several inserts of refractory material resisting an added metal torch are clad with the refractory steel, the structure and distribution at the interior of the steel of this insert or these inserts being such that the plate comprises a series of zones, spaced over the whole of the plate, which are separated by zones in which the thickness of the steel is different.

Thanks to said inserts, the armor according to the invention resists the action of an added metal torch.

Although the steel of the armor has only a limited resistance to an added metal torch, the presence of the insert or the inserts in the midst of the steel prevents the piercing in the armor of a hole sufficiently large to provide access to the other side of the armor. When the armor is attacked by an added metal torch, the action of this latter will be greatly resisted when the flame reaches an insert. If another tool is used to pierce the insert, there will be a loss of time. However, removal of this insert is rendered very difficult given the complex shape of the insert or of the inserts clad with a substrate of steel of varying thickness.

There are known certain armors of concrete in which are embedded inserts of graphite or other refractory compound. However, such concrete-base armors are not suitable for the production of safes of small dimensions adapted to satisfy the mentioned standard. Thus, to resist tools such as a sledge hammer, a pick axe or the like, the concrete-base armors must have a thickness substantially greater than that of steel armors.

According to a preferred embodiment of the invention, the armor plate moreover encloses one or several inserts of material resisting cutting tools.

Thanks to these additional inserts, the armor resists not only an added metal torch, but also special cutting tools such as drills equipped with tungsten carbide or silicon carbide bits.

According to a preferred embodiment of the invention, the material resisting an added metal torch is selected from the group consisting of magnesia, zirconia, alumina, carbon fibers, titanium, zirconium, tantalum, niobium, hafnium and like refractory materials.

Preferably, the material resisting attack by the added metal torch is graphite.

Graphite is one of the most refractory materials known and is of relatively low cost.

Its excellent thermal conductivity has the effect of diffusing the heat supplied by the cracking torch over the whole of the armor, which constitutes an obstacle to its own melting or combustion.

Preferably, the material resisting cutting tools is selected from the group comprising silicon carbide, tungsten carbide, boron carbide, manganese austenitic steel, silicon nitride, tungsten nitride or boron nitride.

Among these materials, silicon carbide is preferred, by virtue of its properties and its cost.

Other characteristics and advantages of the invention will become apparent from the following description.

Figure 2:
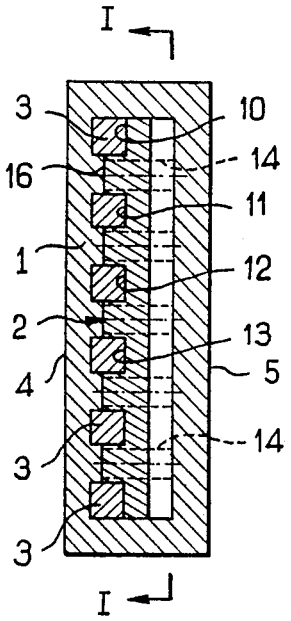
Figure 2A:
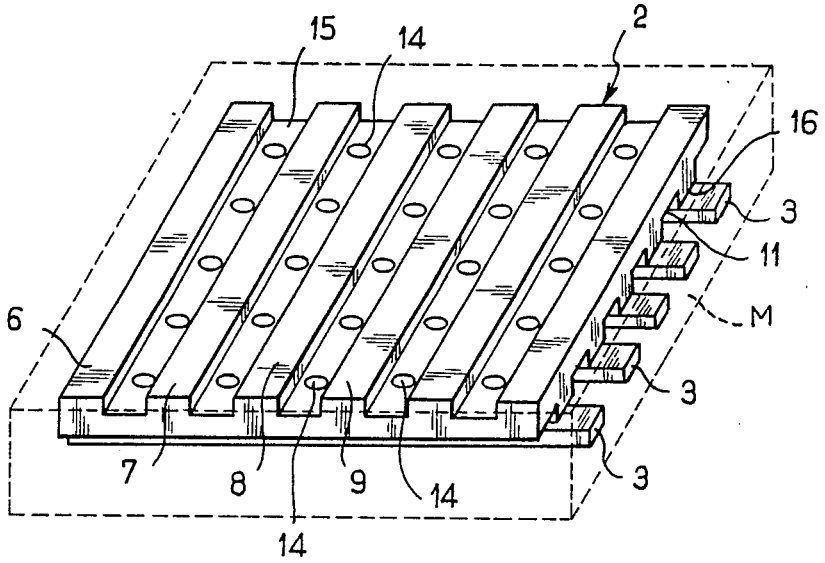
Figure 3:
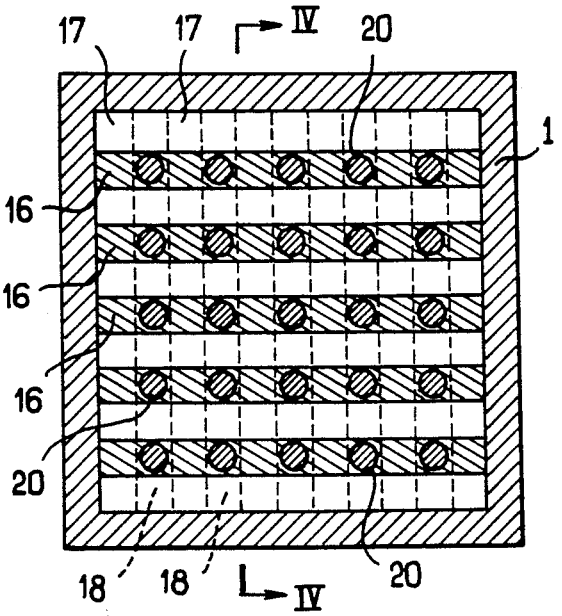
Figure 4:
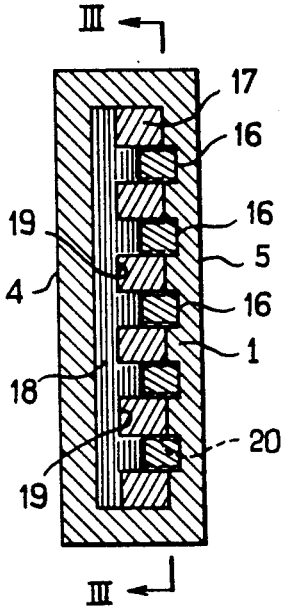
Figure 5:
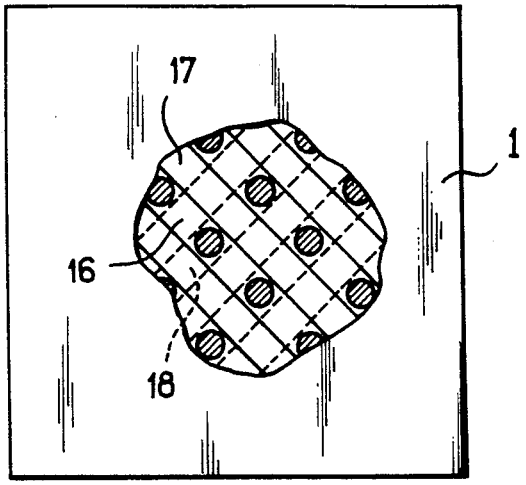
Figure 6:
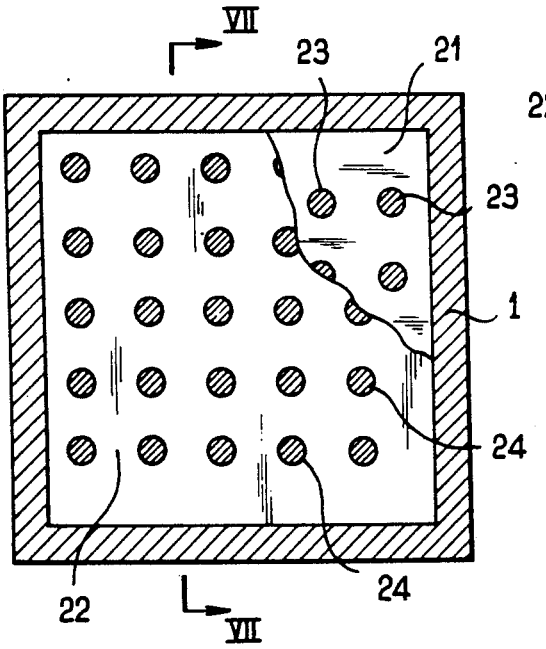
Figure 7:
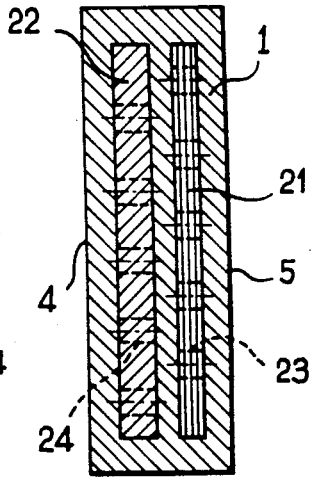

In the accompanying drawings, given by way of non-limiting example:

FIG. 1 is a plan view in section of the upper layer of steel on the plane I—I of FIG. 2, of an armor plate according to the invention, FIG. 2 is a sectional view on plane II—II of FIG. 1, FIG. 2A is an exploded perspective view showing the arrangement of the plate and the bars in a mold adapted to be filled with refractory steel, FIG. 3 is a plan view in section on the plane III—III of FIG. 4, of a first modification of armor according to the invention, FIG. 4 is a view in section on the plane IV—IV of FIG. 3, FIG. 5 is a plan view, with the upper steel layer broken away, of an embodiment analogous to that of FIG. 4, but with a different orientation of the inserts, FIG. 6 is a plan view with parts broken away of another form of embodiment, FIG. 7 is a sectional view on the plane VII—VII of FIG. 6, FIGS. 8A to 8D are partial plan views of modified embodiments showing different orientations of inserts in the form of bars, FIG. 9 is a sectional view on the plane IX—IX of FIG. 8C, FIGS. 10A and 10B are partial plan views of two other modified embodiments, FIG. 11 is a sectional view on the plane XI—XI of FIG. 10A.

In the embodiment of FIGS. 1, 2 and 2A, the safe armor comprises a refractory steel plate 1, for example a high chromium steel, resistant to cracking by means of a conventional torch. An insert 2 of refractory material resisting an added metal torch is embedded in the refractory steel 1. The structure and distribution in the interior of the steel 1 of this insert 2 are such that the plate comprises a series of zones, distributed over all the plate, which are separated by zones in which the thickness of the steel 1 is different.

The plate also encloses inserts 3 of material resistant to cutting tools, such as drills with silicon carbide bits.

The inserts 3 of material resisting cutting tools are disposed near the dorsal surface 4 of the plate.

The material resistant to the added metal torch, which constitutes the inserts 2, is preferably graphite.

The material resistant to cutting tools, which constitutes the inserts 3, is preferably silicon carbide.

In the example shown in FIGS. 1, 2 and 2A, the graphite insert 2 is a plate or a single piece extending parallel to the surfaces 4 and 5 of the armor plate. This graphite plate 2 comprises on each of its surfaces parallel grooves 6, 7, 8, 9; 10, 11, 12, 13, the grooves in one of the surfaces being orthogonal to those in the other surface.

In the grooves 10, 11, 12, 13 adjacent the dorsal surface 4 of the armor plate, are disposed bars 3 of silicon carbide parallel to each other.

Moreover, holes 14 are provided in the graphite plate 2, these holes being filled with the steel which envelopes the inserts 2 and 3.

It can be seen in FIG. 2, that the holes 14 extend through the graphite plate 2 from one side to the other and are disposed at the intersection of the ribs 15 comprised between the grooves such as 7, 8 of one of the surfaces of the plate 2 with the ribs 16 defined between grooves such as 10, 11 of the other surface.

The total thickness of the steel plate is for example 35 mm. The thickness of the graphite plate 2 is for example 12 mm, while that of the bars 3 of silicon carbide is 8 mm.

The steel thickness from one side to the other of the graphite plate 2 and the of bars 3 of silicon carbide is of the order of 8 to 10 mm.

The graphite plate 2 has on its two surfaces (dorsal 4 and front 5) grooves of a cross section of 35×5 mm and of an axial spacing of 60 mm.

The connecting holes 14 filled with steel have a diameter of 30 mm.

The inserts 3 of silicon carbide are rectangular bars of a section of 30×8 mm.

To produce the armor plate shown in FIGS. 1 and 2, it suffices to place in a foundry mold M (see FIG. 2A) the bars 3 of silicon carbide and the graphite plate 2 provided with holes 14, these inserts being maintained in place in the mold by supports of small size, then casting steel into the mold.

Thanks to the holes 14 filled with steel, the graphite plate is solidly connected without discontinuities to the two steel layers present adjacent the surfaces 4 and 5 of the armor plate.

When this armor plate is attacked on its surface 5 with an added metal torch, it is possible to remove the steel layer which covers the graphite plate 2. However, the torch flame will be strongly resisted by the graphite 2.

To obtain a sufficiently large opening in the armor plate, it is necessary first to remove the graphite about several holes 14 filled with steel, then eliminate with the torch the steel contained in the holes 14.

It is necessary then to eliminate the graphite 2 between the bars 3 of silicon carbide, then to eliminate these latter, it being understood that these latter resist special cutting tools and are supported by the steel surface 4 without which percussion tools could destroy them.

Thus, to create an opening in the armor, the cracker must overcome successive obstacles which oblige him each time to change tools, which has the effect of discouraging him.

Tests conducted by the applicant have thus shown that the armor offers sufficient resistance against cracking, permitting its homologization.

In the embodiment of FIGS. 3 and 4, the armor plate encloses several graphite inserts in the form of two series of bars 16, 17 forming a grid. Parallel to the surfaces of the armor plate, the bars 16 of one series are nested in the bars 17 of the other series. Adjacent the dorsal surface 4 of the plate are disposed parallel bars 18 of silicon carbide having recesses 19 in which are nested one 17 of the series of graphite bars. Moreover, the bars 16 of graphite and of silicon carbide are traversed by holes 20 filled with steel, ensuring continuity between the surfaces 4 and 5.

In the case of the embodiment of FIG. 3, as in the previous case, the bars 16, 17 of graphite and the bars 18 of silicon carbide are parallel to the edges of the armor plate.

In the embodiment of FIG. 5, the bars 16, 17 of graphite and the bars 18 of silicon carbide are oblique (forming an angle equal to 45°) with respect to the edges of the armor plate.

In the embodiment of FIGS. 3, 4 and 5, the total thickness of the armor plate is equal to 32 mm. The rectangular bars of graphite 16 and 17 have a cross section of 3×10 mm and their axial spacing is 60 mm.

The bars 18 of silicon carbide have a section of 3×12 mm and their axial spacing is equal to 60 mm. The minimum thickness of the refractory steel covering each surface of the said rods is 5 mm.

In the embodiment of FIGS. 6 and 7, the armor plate encloses a plate 21 of graphite and a plate 22 of silicon carbide spaced from each other and parallel to the surfaces 4, 5 of the armor plate. These two plates 21, 22 are provided with a series of holes 23, 24 filled with steel.

It will moreover be seen that the holes 23 of one 21 of the plates are offset relative to the holes 24 of the other plate 22 but that the monolithic nature of the refractory steel cladding is always maintained.

In the embodiments of FIGS. 6 and 7, the total thickness of the armor is equal to 40 mm. The refractory steel layer on the front surface 5 of the armor is 8 mm. The graphite plate 21 has a thickness of 10 mm with one hole of 20 mm diameter/$dm^2$.

The second layer of refractory steel has a thickness of 8 mm. The silicon carbide plate 22 has a thickness of 15 mm and has one hole of 20 mm diameter/$dm^2$.

The refractory steel layer on the dorsal surface 14 has a thickness of 8 mm.

As in the previous embodiments, a graphite plate 23 resists an added metal torch. To eliminate a sufficiently large surface of graphite, it would be necessary to eliminate by drilling, several regions of steel corresponding to the holes 23. The presence of the plate 22 of silicon carbide and the fact that the holes 23 and 24 are offset and undetectable from the outside complicate even more the task of a possible cracker.

In the embodiment of FIGS. 8A to 8D and 9, the armor plate encloses a first series 25 of parallel bars of graphite and a second series 26 of parallel bars of silicon carbide, spaced and oblique relative to those of the first series.

The angle between the bars 25 and 26 and their orientation relative to the edges of the armor plate can vary from one armor to another or toward the interior of the same armor as shown in FIGS. 8A to 8D.

In the example of FIGS. 8A to 8D and 9, the total thickness of the armor is 28 mm. The cylindrical graphite bars 25 have a diameter of 12 mm and their axial spacing is 35 mm. The cylindrical bars of silicon carbide 26 have a diameter of 16 mm and their axial spacing is 48 mm.

The minimum thickness of refractory steel covering the bars of graphite and silicon carbide is 2 mm.

In the embodiment of FIGS. 10A, 10B and 11, the armor plate encloses a series of small plates 27*a*, 27*b* of graphite parallel to the surfaces 4, 5 of the armor plate and spaced apart. These small plates 27*a*, 27*b* of graphite overlie a series of small plates 28 of silicon carbide mutually spaced apart and offset relative to the small plates 27*a*, 27*b* of graphite.

The orientations between the graphite and silicon carbide plates as well as their shape may be identical (see FIGS. 10A) or different (see FIG. 10B).

The armor plates which have been described can serve for the construction of a safe. According to a preferred characteristic of the invention, the base material being weldable refractory steel, this latter may be fabricated by welding several plates together so as to obtain a parallelepipedal safe.

The first condition for the choice of refractory steel is the necessity to resist attack by a conventional oxyacetylene torch. This condition is achieved by the use of refractory steel whose chromium content exceeds 13%.

The resistance to mechanical attack of this steel is achieved thanks to its hardness and its work hardening tendency.

This steel also has a weldability and a machinability suitable for permitting industrial fabrication.

The refractory steel Z 40 CN 25 - 12M (standard NF A32-057) seems to provide the best compromise.

For graphite inserts, there will preferably be used a pure graphite having a density of 1.7.

By way of variation, the different plates which comprise the safe may be molded in a single piece.

Of course, the invention is not limited to the examples that have been described and numerous modifications can be provided for these latter without departing from the scope of the invention.

Thus, the shape of the graphite inserts and the silicon carbide inserts could be different from those described, provided the distribution of these inserts in the midst of the steel permits creating zones in which the thickness of the steel is different and that these zones will be sufficiently close together to make difficult the elimination of an insert over a surface permitting the passage for example of an arm or a filching tool.

The shape of the graphite and silicon carbide inserts could be irregular and their spacing in the midst of the steel could be random.

One of the interesting features of the armor according to the invention is that the size of the inserts and their spacing within the steel are invisible from outside.

Thus, if the dimensions and this spacing vary from one armor plate to another or from one zone of a plate to another according to a secret arrangement, the crackers can never foresee the difficulties that they must surmount upon attacking the armor.

Of course, the invention can be applied to armors other than those of safes and in particular to armored walls and doors of anything, a simple adaptation of the shapes and thicknesses permitting adapting the same principles with respect to the anti-cracking characteristics required by any other specification than that cited in the introduction of the present description.

What is claimed is:

1. Armor particularly for safes, comprising a weldable refractory steel base plate (1) having two faces, said steel resisting cracking by means of a conventional torch, wherein at least one insert (2, 16, 17, 21, 25, 27*a*, 27*b*) of refractory material resisting an added metal powder torch is encased in the refractory steel (1), the structure and distribution in the interior of the steel of said at least one insert (2, 16, 17, 21, 25, 27*a*, 27*b*) being such that the plate comprises a series of zones, distributed throughout the whole of the plate, which are separated by zones in which the thickness of the steel is different, the plate enclosing moreover at least one insert (3, 18, 22, 26, 28) of drill-resisting material, said inserts being constituted by two series of bars forming a grid embedded in said refractory steel in substantially parallel relationship with the faces of the steel baseplate.

2. Armor according to claim 1, wherein said at least one insert (3, 18, 22, 26, 28) of drill resisting material is disposed adjacent a dorsal surface (4) of the plate.

3. Armor according to claim 1, wherein said material resistant to an added metal powder torch is selected from the group consisting of magnesia, zirconia, alumina, carbon in the form of fibers, titanium, zirconium, tantalum, niobium and hafnium.

4. Armor according to claim 1, wherein said material resisting an added powder torch is graphite.

5. Armor according to claim 1, wherein said material resisting cutting tools is selected from the group consisting of silicon carbide, tungsten carbide, boron carbide, austenitic manganese steel, silicon nitride, tungsten nitride and boron nitride.

6. Armor according to claim 1, wherein the plate encloses an insert of graphite in the form of a plate (2) in a single piece extending parallel to the surfaces (4, 5) of the armor plate, this plate (2) of graphite comprising on each of its surfaces grooves (7, 8, 9; 10, 11, 12), the grooves in one of the surfaces being oriented differently from those of the other surface, the grooves adjacent a dorsal surface (4) of the armor plate containing bars (3) of silicon carbide, and there being holes (14) in the plate (2) of graphite, these holes (14) being filled with steel (1).

7. Armor according to claim 6, wherein the holes (14) pass through the plate (2) of graphite from one side to the other and are disposed at the intersection of ribs provided between the grooves (7, 8) of one of the surfaces with those (16) of the other surface.

8. Armor according to claim 1, wherein the plate encloses several inserts of graphite in the form of two series (16, 17) of the bars forming a grill, parallel to the surfaces (4, 5) of the armor plate, the bars of one series being nested in the bars of the other series, and adjacent a dorsal surface (4) of the plate there being disposed parallel bars (18) of silicon carbide having recesses (19) engaged over one (17) of the series of graphite bars, and the graphite bars and silicon carbide bars being traversed by holes (20) filled with steel.

9. Armor according to claim 6, wherein at least some of said grooves and bars are parallel to edges of the armor plate.

10. Armor according to claim 6, wherein at least some of said grooves and bars are oblique relative to edges of the armor plate.

11. Armor according to claim 1, wherein the armor plate encloses a plate (21) of graphite and a plate (22) of silicon carbide spaced from each other and parallel to the surfaces (4, 5) of the armor plate, these two plates (21, 22) being provided with a series of holes (23, 24) filled with steel (1).

12. Armor according to claim 11, wherein the holes (23) of one of the plates are offset relative to the holes (24) of the other plate.

13. Armor according to claim 1, wherein the plate encloses a first series (25) of parallel bars of graphite and a second series (26) of parallel bars of silicon carbide which are oblique relative to the bars of the first series.

14. Armor according to claim 1, wherein the armor plate encloses a series of small plates (27*a*, 27*b*) of graphite parallel to the surfaces (4, 5) of the armor plate and spaced apart, the small plates of graphite overlying a series of small plates (28) of silicon carbide spaced apart from each other and offset relative to the small plates of graphite.

15. Armor according to claim 1, wherein the refractory steel which constitutes the substrate of the armor intimately encloses a plurality of said anti-cracking inserts.

16. Armor according to claim 1, wherein the refractory steel which constitutes the substrate of the armor ensures absolute continuity between the front surface and the dorsal surface of the armor by passing through numerous holes of a plurality of said anti-cracking inserts.

17. Armor particularly for safes, comprising a weldable refractory steel base plate (1) having two faces, said steel resisting cracking by means of a conventional torch, wherein at least one insert (2, 16, 17, 21, 25, 27*a*, 27*b*) of refractory material resisting an added metal powder torch is encased in the refractory steel (1), the structure and distribution in the interior of the steel of said at least one insert (2, 16, 17, 21, 25, 27*a*, 27*b*) being such that the plate comprises a series of zones, distributed throughout the whole of the plate, which are separated by zones in which the thickness of the steel is different, the plate enclosing moreover at least one insert (3, 18, 22, 26, 28) of drill-resisting material, said inserts being constituted by a plate comprising recesses embedded in said refractory steel, in substantially parallel relationship with the faces of the steel base-plate.

18. Armor according to claim 17, wherein said at least one insert (3, 18, 22, 26, 28) of drill resisting material is disposed adjacent a dorsal surface (4) of the plate.

19. Armor according to claim 17, wherein said material resistant to an added metal powder torch is selected from the group consisting of magnesia, zirconia, alumina, carbon in the form of fibers, titanium, zirconium, tantalum, niobium and hafnium.

20. Armor according to claim 17, wherein said material resisting an added powder torch is graphite.

21. Armor according to claim 17, wherein said material resisting cutting tools is selected from the group consisting of silicon carbide, tungsten carbide, boron carbide, austenitic manganese steel, silicon nitride, tungsten nitride and boron nitride.

22. Armor according to claim 17, wherein the plate encloses an insert of graphite in the form of a plate (2) in a single piece extending parallel to the surfaces (4, 5) of the armor plate, this plate (2) of graphite comprising on each of its surfaces grooves (7, 8, 9; 10, 11, 12), the grooves in one of the surfaces being oriented differently from those of the other surface, the grooves adjacent a dorsal surface (4) of the armor plate containing bars (3) of silicon carbide, and there being holes (14) in the plate (2) of graphite, these holes (14) being filled with steel (1).

23. Armor according to claim 22, wherein the holes (14) pass through the plate (2) of graphite from one side to the other and are disposed at the intersection of ribs provided between the grooves (7, 8) of one of the surfaces with those (16) of the other surface.

24. Armor according to claim 17, wherein the plate encloses several inserts of graphite in the form of two series (16, 17) of the bars forming a grill, parallel to the surfaces (4, 5) of the armor plate, the bars of one series being nested in the bars of the other series, and adjacent a dorsal surface (4) of the plate there being disposed parallel bars (18) of silicon carbide having recesses (19) engaged over one (17) of the series of graphite bars, and the graphite bars and silicon carbide bars being traversed by holes (20) filled with steel.

25. Armor according to claim 22, wherein at least some of said grooves and bars are parallel to edges of the armor plate.

26. Armor according to claim 22, wherein at least some of said grooves and bars are oblique relative to edges of the armor plate.

27. Armor according to claim 17, wherein the armor plate encloses a plate (21) of graphite and a plate (22) of silicon carbide spaced from each other and parallel to the surfaces (4, 5) of the armor plate, these two plates (21, 22) being provided with a series of holes (23, 24) filled with steel (1).

28. Armor according to claim 27, wherein the holes (23) of one of the plates are offset relative to the holes (24) of the other plate.

29. Armor according to claim 17, wherein the plate encloses a first series (25) of parallel bars of graphite and a second series (26) of parallel bars of silicon carbide which are oblique relative to the bars of the first series.

30. Armor according to claim 17, wherein the armor plate encloses a series of small plates (27*a*, 27*b*) of graphite parallel to the surfaces (4, 5) of the armor plate and spaced apart, the small plates of graphite overlying a series of small plates (28) of silicon carbide spaced apart from each other and offset relative to the small plates of graphite.

31. Armor according to claim 17, wherein the refractory steel which constitutes the substrate of the armor intimately encloses a plurality of said anti-cracking inserts.

32. Armor according to claim 17, wherein the refractory steel which constitutes the substrate of the armor ensures absolute continuity between the front surface and the dorsal surface of the armor by passing through numerous holes of a plurality of said anti-cracking inserts.

* * * * *